United States Patent [19]

Busch

[11] Patent Number: 4,790,223

[45] Date of Patent: Dec. 13, 1988

[54] METHOD AND APPARATUS FOR SEPARATING OFF INDIVIDUAL ITEMS FROM A STACK OF PRECUT STRIPS

[76] Inventor: Gerhard Busch, Brookdamm 28, D-2105 Seevetal 2 (Meckelfeld), Fed. Rep. of Germany

[21] Appl. No.: 39,286

[22] Filed: Apr. 17, 1987

[30] Foreign Application Priority Data

Apr. 18, 1986 [DE] Fed. Rep. of Germany ..... 3613563
Aug. 21, 1986 [DE] Fed. Rep. of Germany ..... 3628301

[51] Int. Cl.[4] ..... B26D 7/02; B26D 7/04

[52] U.S. Cl. ..... 83/48; 83/282; 83/454; 83/456; 83/465; 83/466; 83/696

[58] Field of Search ..... 83/32, 42, 48, 697, 83/465, 466, 375, 452, 454, 696, 282, 456

[56] References Cited

U.S. PATENT DOCUMENTS

| | | | |
|---|---|---|---|
| 207,146 | 8/1878 | Wilson et al. | 83/697 |
| 1,202,546 | 10/1916 | McDonald | 83/48 |
| 1,729,582 | 9/1929 | Kast | 83/465 |
| 2,027,925 | 1/1936 | Murray | 83/48 |
| 2,335,292 | 11/1943 | Messenger | 83/48 |
| 3,108,508 | 10/1963 | Warden | 83/465 |
| 4,024,593 | 5/1977 | Pendell | 83/42 |

FOREIGN PATENT DOCUMENTS

| | | | |
|---|---|---|---|
| 2839236 | 3/1979 | Fed. Rep. of Germany | 83/465 |
| 1367107 | 9/1974 | United Kingdom | 83/42 |

*Primary Examiner*—Frank T. Yost
*Assistant Examiner*—Scott A. Smith
*Attorney, Agent, or Firm*—Bell & Arkin

[57] ABSTRACT

For separating off a stack of individual shaped items such as bottle neck labels from a stack of strips each carrying several such items, a punching die is used which has a punching contour which corresponds to the desired shape of the cutting line between the individual shaped items. The cutting line also corresponds to the rear contour of the separate stack of individual shaped items. The shape of the cutting line of the punching die is freely selectable. At its rear edge the punching die is smooth and the separated-off stack of shaped items accommodates any compression of the material forming the stack by means of an offset angle so that the remainder of the strip of shaped items has a smooth and perpendicular cut edge.

9 Claims, 4 Drawing Sheets

METHOD AND APPARATUS FOR SEPARATING OFF INDIVIDUAL ITEMS FROM A STACK OF PRECUT STRIPS

FIELD OF THE INVENTION

The invention relates to a method of and an apparatus for separating off a stack of individual items, for instance printed bottle neck labels, from a stack of precut strips, each of which carries several such items in an internested arrangement, involving a punching die having the contour of the items which are to be punched out and which is adapted for movement towards a punching table.

DESCRIPTION OF PRIOR ART

Present day printed items, for example labels and the like, are in many cases printed so that several are printed together on a sheet with a projecting part of one item fitting into a recessed part of an adjacent item, and are then further processed on automatic punching presses. Connecting of the punching lines creates punching bridges which have to be removed before further processing can take place; this is time-consuming and expensive. Small quantities of items are often punched by means of applied dies which do, however, result in some throwing upwards of the paper stack and the higher the stack the greater this throwing upwards will be. For high-quality products and large production quantities therefore ram-type punching machines have been developed which punch the material through the die, avoiding these punching bridges and managing with very small tolerances.

Depending on the scale of production, the blanks for these ram-type machines are placed on one another in stacks of 500 to 1250 sheets and are cut at a rightangle in strips on paper cutters. Each strip contains a plurality of groups of individually shaped items which are separated from the blank by a cutting machine. Following downstream of this strip puncher is a ram-type punching machine by means of which the individual items receive their final outer contours. Internesting of the individual items such as is desired in order to economise on paper, is not possible with tall stacks since they can only be processed with a diagonal cut which permits only straight cuts. The resultant rectangular blanks involve considerable financial loss when the shapes are heavily contoured, since paper and printing represent some 70 to 80% of the production costs.

SUMMARY OF THE INVENTION

An object of the invention is to provide a method of cut-punching precut strips of heavily contoured individually shaped items in which the waste caused by the pre-production in reduced to a minimum.

This problem is resolved in that each stack of individually shaped items is so separated from the rest of the strip material by a punching cut extending perpendicular to the strip and having a punching line of freely-selectable shape such that the rear contour of the stack of single items separated off from the strip is at the same time the front contour of the next stack of single items be separated from the strip.

By adopting these measures, it is possible to separate off internested individually shaped items with one punching operation which represents a considerable saving on paper. It is possible also for two or three punching units to be coupled together in sequence, by means of which the first unit effects the punching cut of the front edges, while the back edges of the individually items are cut-punched in the second or third unit. It is for e.g. also possible to cut-punch in the second unit a separating line for groups of items of kidney-shaped, trapezoidal or triangular forms, which are often produced in the detergent or phamaceutical industry. The individualy shaped items can be moved up very close to one another on the sheet so that paper wastage is reduced to a minimum.

The stacks of individually shaped items are pressed down along a contour to which the pressure is applied by a presser bar or bar in the region of the desired cutting line. The distance from the cutting line to the contour to which the pressure is applied may be varied, so that differences is the depressed stack may occur resulting in throwing upwards of individual items.

It is known from German Patent Specification No. 685 530 to sub-divide the presser bar into individual parts, this sub-division allowing the presser bar to compensate for differing thicknesses underneath whilst exerting a constant to a cutting line which lies at varying distances from the pressing contour.

A further object of the invention is to provide an apparatus for separating internested stacks of single items from the strip along a cutting line of variable shape.

This problem is solved in that the pressing contour of the presser bar can be varied by means of interchangeable displaceable holding means.

BRIEF DESCRIPTION OF THE DRAWINGS

The invention is described in greater detail hereinafter with reference to an embodiment which by way of example is shown in the accompanying drawings, in which.

DESCRIPTION OF THE PREFERRED EMBODIMENT

Figure 1:
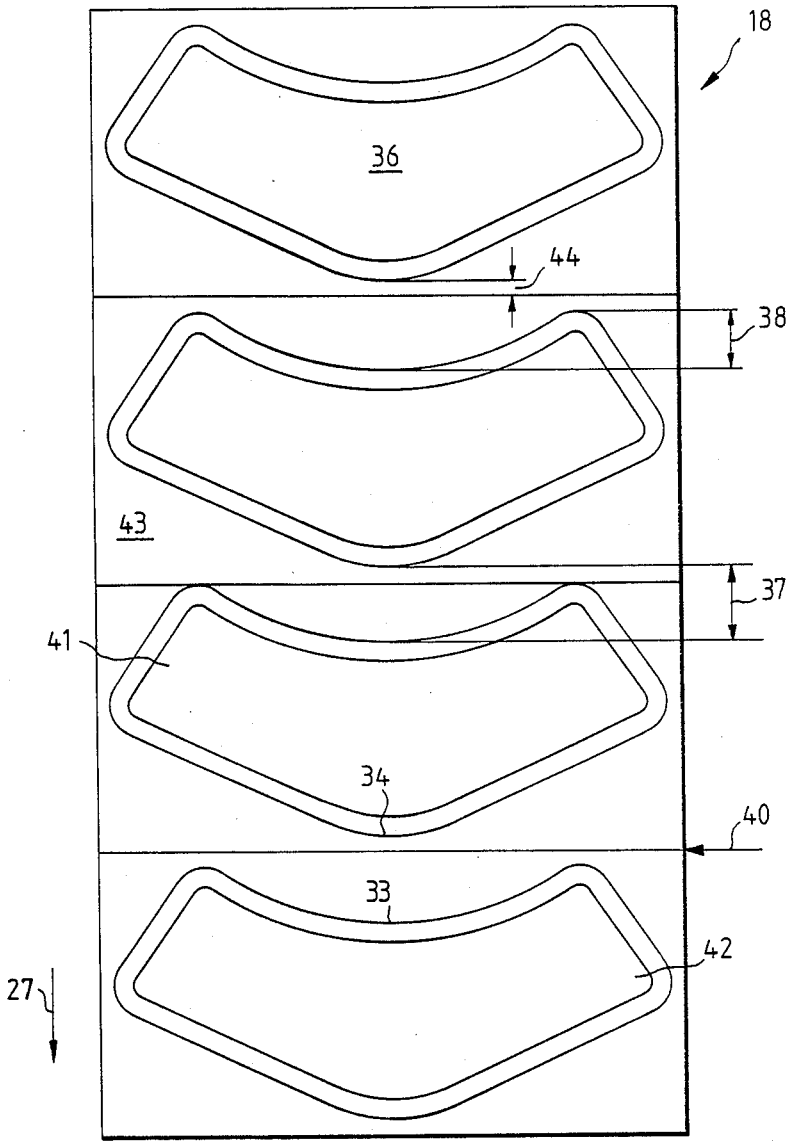
FIG. 1 is a diagrammatic representation of a precut strip with the individual shaped items conventionally arranged for right-angled single item blanks.
Figure 2:
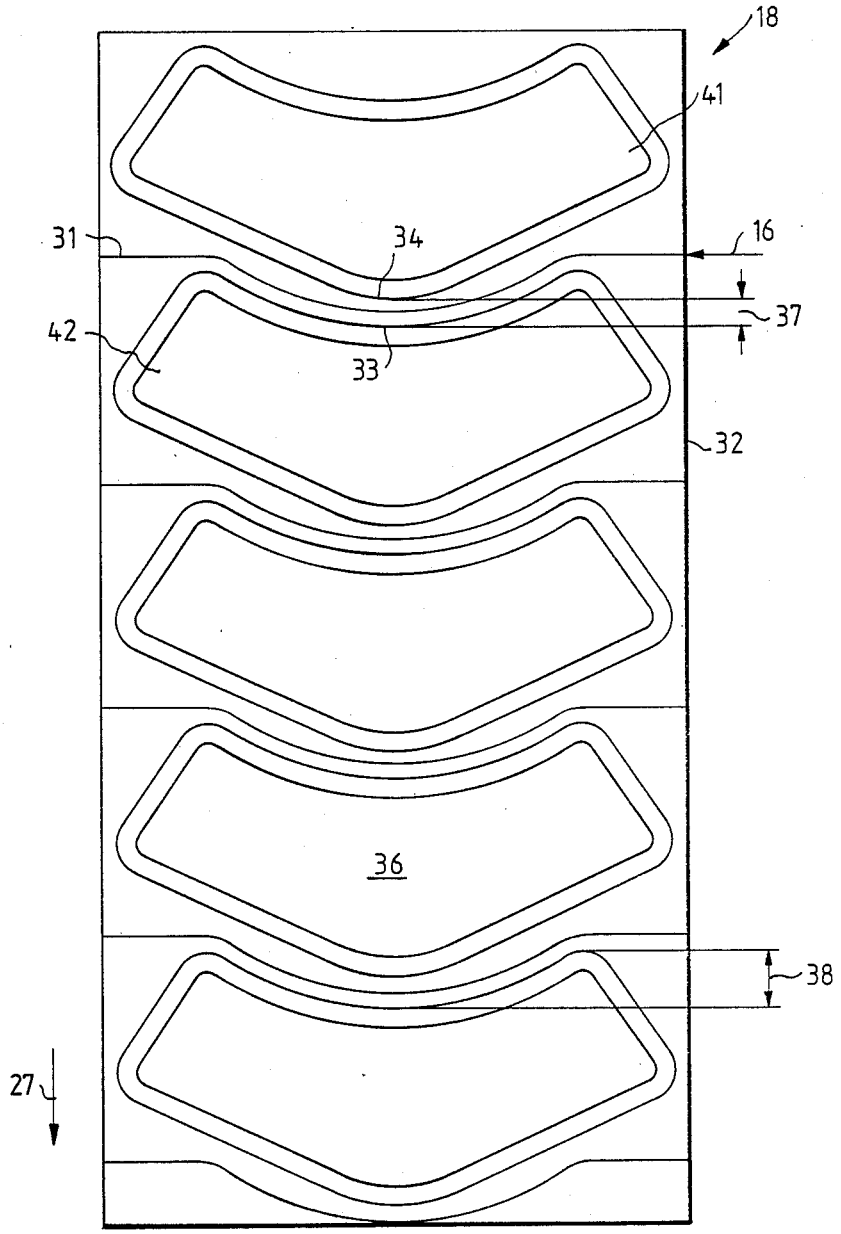
FIG. 2 is a diagrammatic view of a precut strip of shaped items with internesting individual shaped items to be cut-punched along a contoured cutting line.

The strips of shaped items 18 shown in FIG. 1 and FIG. 2 carry a plurality of individual shaped items 36. The lateral edges 32 of the strips 18 extend straight and parallel to one another. On the strip 18 shown in FIG. 1, the individual shaped items 36 are, in a hitherto conventional manner, disposed far enough apart to be separable from one another along a straight cutting line 40. In this way, rectangular blanks result, from which the individual shaped items 36 are punched on a following ram-type punching machine which is not shown.

The cutting line 40 extends between the front contour 34 of the following shaped item 41 and the rear contour 33 of the front or leading shaped item 42, relative to the direction of feed 27 (indicated by the arrow). The shaped items 41 and 42 are at a sufficiently great distance 37 apart that a free diagonal cut is possible. The gap 37 between adjacent shaped items will depend upon the depth of the recess formed by the contour 38 and the gap 44 between the edges, i.e. between the front contour 34 and the cutting line 40. Since this distance 37 may be quite considerable, the amount of unusable waste paper 43 can be quite substantial.

On the strip of shaped items 18 shown in FIG. 2, the individual items 36 are in an internesting arrangement and are moved closer together such that there is only a small gap 37, which corresponds to the distance apart of the leading shaped item 42 from the cutting edge 31 and from the cutting edge 16 to the subsequent shaped item 41. The area of waste paper 43 is thus reduced so that a greater number of shaped items can be accommodated on a strip of the same size. The thus-internested shaped items are separated from the strip 18 of shaped items along a contoured cutting line 16. The final contour will be punched in a following process in a ram-type punching machine, unless the final contour is already achieved by means of the cut-punching.

Figure 3:
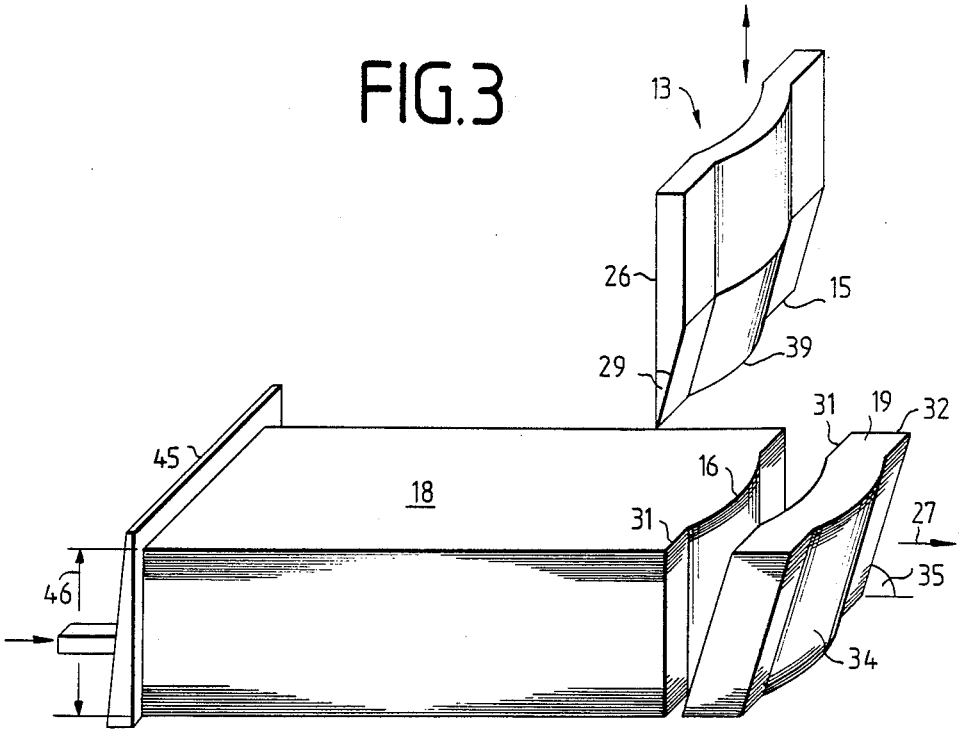
FIG. 3 is a diagrammatic view of the strip punching process with a contoured cutting line for the processing of strips of shaped items as shown in FIG. 2.

As FIG. 3 shows, for separating off such a stack 19 from the strip 18 of shaped items, a punching die 13 is used, the punching contour 39 of which corresponds to the shape of the cutting line 16 between the individual shaped items 36. To this end, the strip 18 is pushed under the punching die 13 by a feeder-pusher 45. The shape of the cutting line 16 of the punching die 13 can be chosen as desired to follow at least partially the rear contour 33 of the separated-off stack 19. The separated stack 19 of individual items accommodates the compression generated by the punching die 13 in the form of an angle 35 by which it is offset in the working direction 27 (as indicated by the arrow). This offset angle 35 extends continuously over the entire stack height 46 so that dimensionally accurate individual shaped items 36 are formed, although they may indeed be offset in the stack. The punching die 13 has a straight rear edge which produces a smooth cutting edge 31 on the remaining strip 18, and permits subsequent alignment by which the stacks 19 of shaped items are re-aligned prior to further processing, the individual shaped items 40 being again exactly superimposed. The heights 46 of stacks to be punched can thus be substantially greater.

Figure 6:
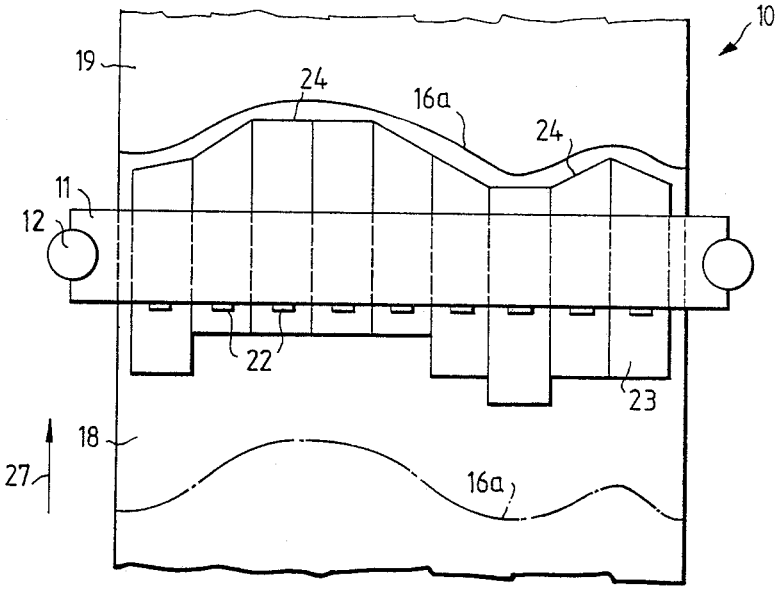
FIG. 6 is a plan view of cut-punching unit as shown in FIG. 4 with a presser bar having displaceable push-in pieces.
Figure 4:
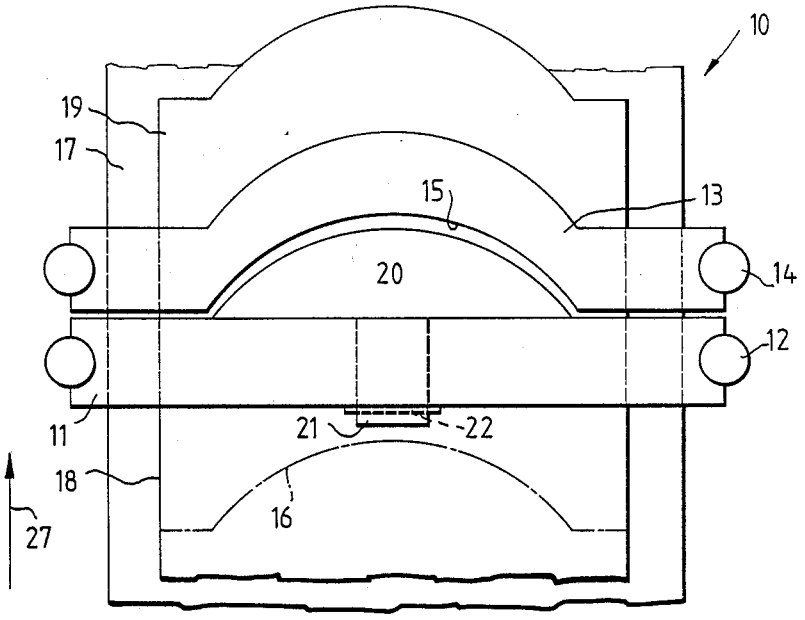
FIG. 4 is a plan view of a strip of shaped items held on the punching table of a cut-punching unit under a presser bar provided with a make-ready part and from which one stack of shaped items is being separated by a stamping die.
Figure 5:
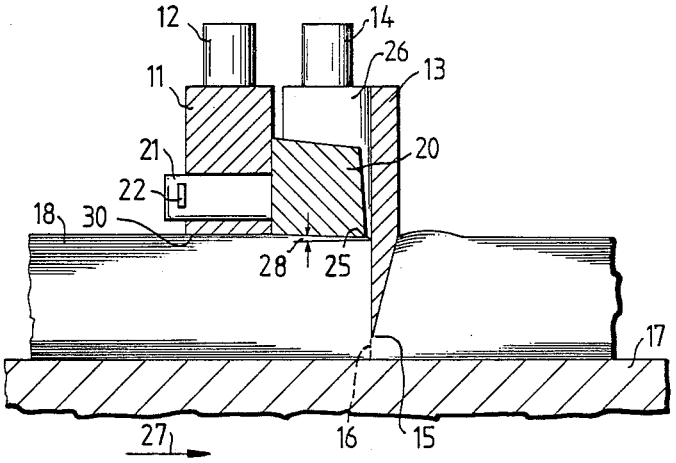
FIG. 5 is a side view of the cut-punching unit as shown in FIG. 4

The strips 18 of shaped items which are to be punched out should as far as possible be held down close to the cutting line 16 in order to prevent the individual shaped items 36 from being thrown upwards. In FIGS. 4 through 6, a cut-punching unit 10 is shown in which a presser bar 11 presses the inserted strip 18 of shaped items down onto a punching table 17. As FIG. 4 shows, the individual stacks 19 can, by means of a punching die 13, be separated from the strip 18 along the cutting line 16. The presser bar 11 is thereby guided in a presser bar guide 12 while the punching die 13 is guided in a punching die guide 14. In the case of the embodiment shown, these guides 12 and 14 extend perpendicularly and are disposed one behind another, but a common guide arrangement or a laterally-adjacent disposition may also be possible.

As FIG. 5 shows, there is pushed into the clamping or presser bar 11 a make-ready part or clamping member 20, the front edge 25 of which extends in the working direction 27 (arrow) as far as the region of the cut-punching edge 15 of the punching die 13. The make-ready part 20 is provided with one or more holders 21 and is secured to the presser bar 11 by fixings 22. In this example of embodiment, the punching die 13 has a hollow cylindrical inner contour 26 which at least partially surrounds the make-ready part 20. To this end, the cutting edge 15 is provided with an angle 29 which forces the separated stack 19 of shaped items to be displaced in the working direction 27 (arrow). To increase the strength of the punching die 13, the cutting edge angle 29 is chamfered.

In the case of the example shown in FIG. 6, the presser bar 11 is provided with a plurality of push-in items or clamping members 23 adapted for movement relative to the bar. These push-in items or clamping members are each provided with holders 21 and fixings 22 on the presser bar 11 in various positions to enable the pressing contour 24 to be adapted to the shape of the cutting line **16*a***.

The front edges 25 of the clamping members 20 and 23 can diverge from the alignment of the bottom edge 30 of the presser bar 11, so that the undersurface of the respective clamping member is downwardly inclined towards the line of cut **16*a*, by identical or differing angles of incidence 28. The result is an initial tension by which moment of the holding means 20 or 23** relative to the presser bar guide is compensated for.

By having different angles of incidence 28 on individual push-in items 23 it is possible within one pressing contour 24 to achieve different initial tensions by which it is possible, for instance, to compensate for fluctuations in tolerance, for example, which result from difference in the height and structure of the material, different applications of printing ink, embossing, composition of materials and the like.

What is claimed is:

1. A method of separating stacks of individual shaped items from precut stacked strips of the shaped items, comprising the steps of superimposing individual shaped items in multilayer stacked strips of the shaped items with the shapes of the shaped items fitted into one another, applying downward pressure against said stacked strips substantially along a horizontally non-straight line which corresponds in configuration to a horizontally non-straight punch line between said individual shaped items corresponding to the shape of said individual items, and separating stacks of the individual shaped items along said punch line.

2. A method according to claim 1, which includes superimposing 500 to 1000 of the individual shaped items in the stacked strips of items.

3. A method according to claim 2, wherein the punch line at which the stack of items containing the leading items are separated from the strips of stacked items extends so that the trailing contour of the separated stack of items is also the leading contour of the succeeding stack of items.

4. A device for separating stacks of individual shaped items from precut stacked strips of the shaped items, comprising:

a punching table;

punching means movable relative to said punching table for separating the stacks;

presser means for holding the strips during the separation of the stacks;

said presser means including a clamping member shaped for pressing against said strips along a horizontally non-straight line which corresponds in configuration to a horizontally non-straight line of cut between successive stacks of said items.

5. A device according to claim 4, wherein said clamping member is replaceably inserted into said presser means.

6. A device according to claim 5, wherein said clamping member has an undersurface downwardly inclined towards the line of cut.

7. A device according to claim 4, wherein said clamping member comprises a plurality of individual clamping members independently horizontally adjustable to extend to said horizontally non-straight line of cut between said successive stacks of items.

8. A device according to claim 7, wherein each of said clamping members has an undersurface downwardly inclined towards the line of cut.

9. A device for separating stacks of individual shaped items from precut stacked strips of the shaped items, comprising:

a punching table;

punching means movable relative to said punching table for separating the stacks;

presser means for holding the strips during the separation of the stacks;

said pressure means comprising means for adjustably holding down said stack in the vicinity of an intended line of cut, said means for holding down including means for varying a contour along which said means for holding down presses against said strips wherein said means for adjustably holding down the stack comprise a replaceable clamping member shaped to extend to said line of cut between said successive stacks of said items and inserted into said presser means, said clamping member having an under surface downwardly inclined towards said line of cut.

* * * * *